US006726572B1

(12) United States Patent
Versen

(10) Patent No.: US 6,726,572 B1
(45) Date of Patent: Apr. 27, 2004

(54) POP-UP SURPRISE

(76) Inventor: Thomas R Versen, 11232 Vista Sorrento Pkwy. M306, San Diego, CA (US) 92130

( * ) Notice: Subject to any disclaimer, the term of this patent is extended or adjusted under 35 U.S.C. 154(b) by 0 days.

(21) Appl. No.: 10/347,560

(22) Filed: Jan. 21, 2003

(51) Int. Cl.[7] ..... A63H 37/00
(52) U.S. Cl. ..... 472/54; 446/308
(58) Field of Search ..... 472/51, 52, 54, 472/55; 446/308, 309, 310

(56) References Cited

U.S. PATENT DOCUMENTS 842,659 A * 1/1907 Haverman ..... 446/310
978,489 A * 12/1910 Salmond ..... 446/310
2,233,119 A * 2/1941 Anderson ..... 446/14
2,858,644 A * 11/1958 Derham ..... 446/310
3,586,320 A * 6/1971 Mace ..... 472/54
3,820,499 A 6/1974 Kliewer et al.
5,055,084 A * 10/1991 Jokic ..... 446/486
5,090,569 A * 2/1992 Nissen et al. ..... 206/457
5,144,880 A 9/1992 Schmit
5,624,320 A * 4/1997 Martinez ..... 472/51
6,001,019 A * 12/1999 Al-Bannai ..... 472/54

* cited by examiner

*Primary Examiner*—Kien T. Nguyen
(74) *Attorney, Agent, or Firm*—Mark Levy & Associates

(57) ABSTRACT

"Pop-Up Surprise is a novelty gift idea designed to blend naturally with any bouquet of flowers and seemingly magically delivers a pre-printed message to its recipient. The pop-up mechanism resembles a flower stem, is green in color and is height adjustable. The silk bud or other outer housings are stand alone pieces designed to house a banner on which the message will be written. The outer housing (Silk bud in this example) easily snaps on the top of the outer stem. A spring and a plastic pop-up rod are parts of the internal mechanism designed to pop the banner up through the outer housing. A timed release tablet dissolves in water over a period of 24 hours releasing the pop-up rod which pushes the banner up through the outer housing, revealing the banner with a pre-printed message. The result is an unexpected surprise!

45 Claims, 7 Drawing Sheets

POP-UP SURPRISE

FIELD OF THE INVENTION

The present invention relates to novelty gifts and more particularly, to a novelty gift with seemingly magical qualities that reveals a pre-printed message via a timed release mechanism.

BACKGROUND OF THE INVENTION

People have always been fascinated with magic and the thrill of surprise. Pop-up surprise, a novel gift idea, combines both of these elements. Imagine sending a beautiful bouquet of flowers to someone. Of course that person is thrilled, but now imagine a pre-printed message that magically appears in that bouquet 24 hours after receiving it. The message could read "I love you more today then I did yesterday." It's the one, two of gift giving. Not only is the person thrilled by the initial gift of flowers, but a second surprise comes when pop-up surprise mysteriously delivers a message approximately 24 hours later.

The message is contained in a variety of compartments camouflaged by outer housings appropriate to floral arrangements. In this example, a plastic flower bud is used; however, other designs such as ladybugs, butterflies, baby rattles, miniature presents, and Easter eggs may also be used. These types of outer housings will go without suspicion when arranged with the flowers, and then the 24-hour timed release tablet dissolves, releasing the spring. This seemingly magical message now appears in the floral arrangements hours after delivery, bringing the recipient additional joy and wonderment.

Although the concept of a time-delayed pop-up message (see Schmit, U.S. Pat. No. 5,144,880) and a gaseous product causing a thermometer to pop-up (see Kliewer et al., U.S. Pat. No. 3,820,499) is in existence, the idea of a timed release tablet that dissolves in water and releases a spring loaded banner which pops-up over a period of 24 hours is not anticipated by those patents.

Because there are no other products that reveal a pre-printed message, which pop-up by way of a timed release tablet, this one of a kind idea stands alone as a unique and novel gift idea.

It is therefore an object of the invention to seemingly magically reveal a pre-printed message 12 to 24 hours after receiving a floral arrangement with a pop-up surprise.

It is another object of the invention to design the outer housings to blend naturally when arranged with any bouquet of flowers.

It is another object of the invention to have the ability to be assembled quickly, easily, and safely.

It is another object of the invention to be easily cut to size with normal floral tools.

SUMMARY OF THE INVENTION

In accordance with the present invention, there is provided a novelty gift idea with seemingly magical qualities that reveals a pre-printed message via a timed release mechanism. Because of its design, pop-up surprise blends naturally when arranged with any real bouquet of flowers. Two of its main components include a pop up mechanism designed to resemble a flower stem, and the outer housing. A silk bud is used for the outer housing in this example. Other outer housings are optional. The outer stem is green in color and made of plastic. The silk bud (outer housing) is a stand-alone piece designed to house the banner on which the pre-printed message will be written. The silk bud (outer housing) is designed to snap on the top of the outer stem. A spring and a plastic (polypropylene) pop-up rod are parts of the internal mechanism designed to pop the banner up through the silk bud (outer housing). A timed release tablet made up of sodium citrate and sodium acetylsalicylate is glued in place with a water soluble glue with a 12-hour melting time. These two components dissolve in water over a period of 24 hours releasing the spring loaded pop-up rod that pushes the banner up through the silk bud (outer housing), revealing the message. Optional outer housings, such as butterflies, baby rattles, miniature presents, Easter eggs, or anything that matches the theme or intent of the floral arrangement, may be manufactured.

BRIEF DESCRIPTION OF THE DRAWINGS

A complete understanding of the present invention may be obtained by reference to the accompanying drawings, when considered in conjunction with the subsequent, detailed description, in which.

For purposes of clarity and brevity, like elements and components will bear the same designations and numbering throughout the FIGURES.

DETAILED DESCRIPTION OF THE PREFERRED EMBODIMENT

Generally speaking, the invention pertains to a novelty gift and, more particularly, to a novelty gift with seemingly magical qualities, revealing a pre-printed message via a timed release mechanism. Pop-up surprise is primarily made up of plastics; however, other materials may be used. The initial intent of pop-up surprise is for use by florists as an add-on product to sell to their customers, much like a mylar balloon. General consumers can also purchase this product through other means for their own use.

The essence of pop-up surprise is its ability to conceal a handwritten or preprinted message in an outer housing 10 that blends aesthetically with any real bouquet of flowers and then magically reveals itself hours later. Imagine receiving a bouquet of flowers. Now imagine looking at that same bouquet of flowers hours later, but now there's a banner 13 (FIG. 2) that has magically revealed itself with a special message written on it from the person who sent them.

Figure 1:
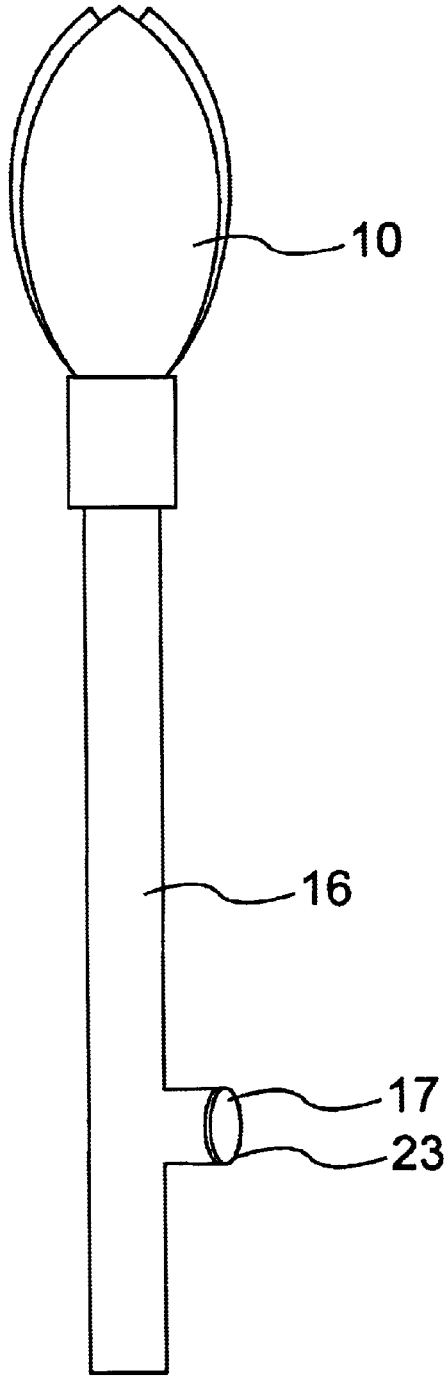
FIG. 1 is a perspective view of an external representation of pop-up surprise in accordance with the invention.

FIG. 1 is a perspective view of an external representation of pop-up surprise in accordance with the invention. The Outer housing 10 (FIG. 1) is an example of just one of the many outer housings that may be used to conceal the banner 13 (FIG. 2) containing the preprinted message. Its flower bud shape is designed to go without suspicion in any real bouquet of flowers and is made of silk, plastic, paper, or any material that aesthetically matches that of a real flower.

Figure 9:
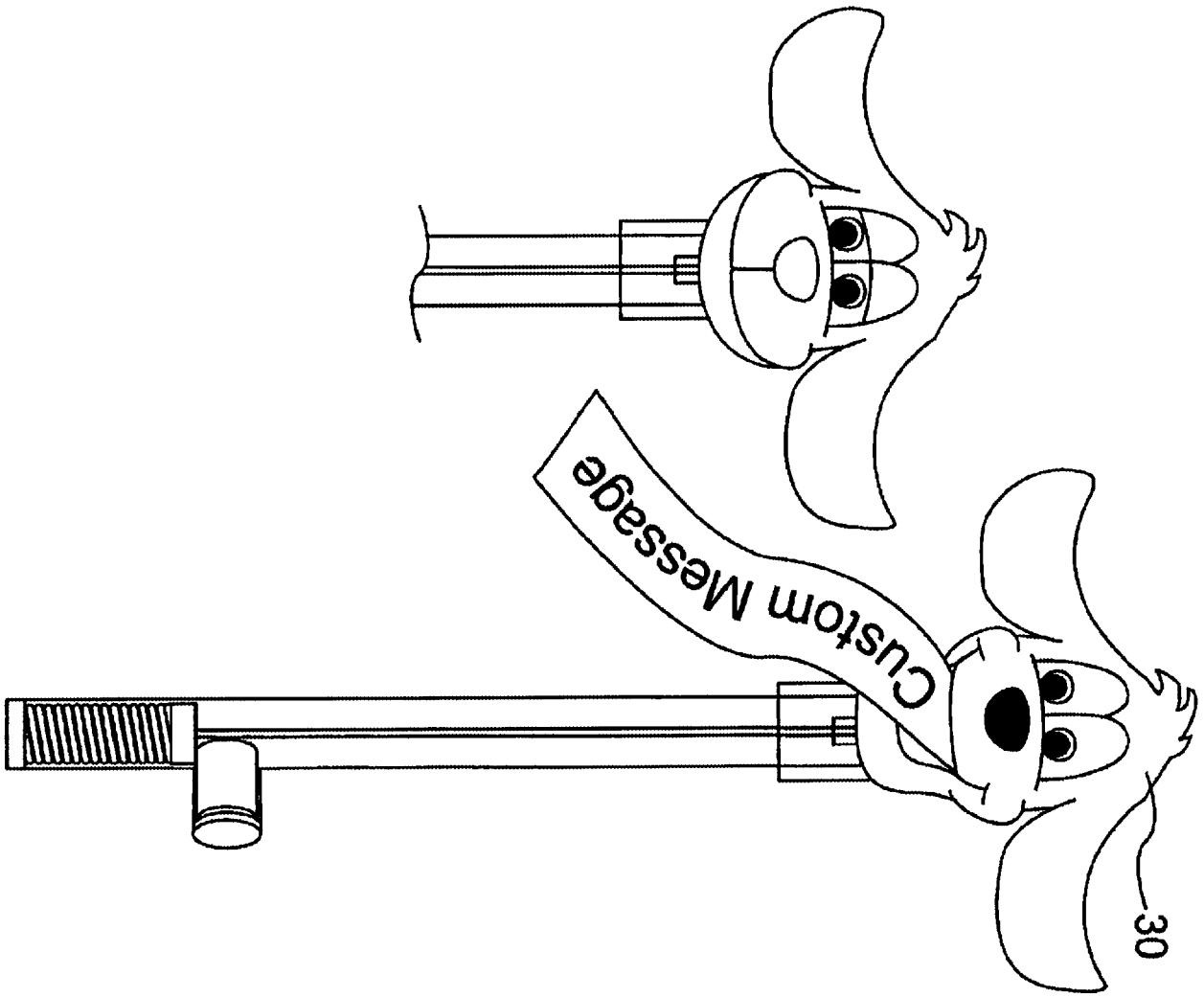
FIG. 9 is a perspective view of a dog's face.

FIG. 9 illustrates a dog's face, which is another sample of an outer housing 10 that could be arranged in a floral arrangement. This type of outer housing 10 could be used for someone who loves dogs or just got a new puppy. FIG. 9 has two illustrations. One features just the dog's face and the other displays the preprinted message. Other outer housings 10 could include a miniature present, Easter egg, ladybug, or baby rattle. Different outer housings needed to match the theme for which flowers are given may be manufactured.

Figure 5:
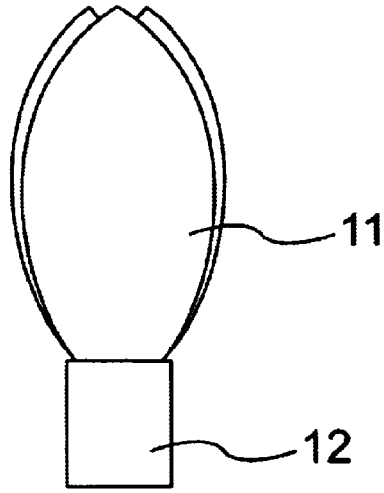
FIG. 5 is a perspective view of a stand-alone look at the press on the outer housings.

FIG. 5 is a perspective view of the banner compartment 11, which is where the banner 13 (FIG. 2) with the custom message is concealed. This area must be large enough to contain a banner 13 (FIG. 2) made of ribbon, paper, or cloth that when rolled or folded up will rest inconspicuously within that space. This holds true with any outer housing 10 that may be used.

Figure 8:
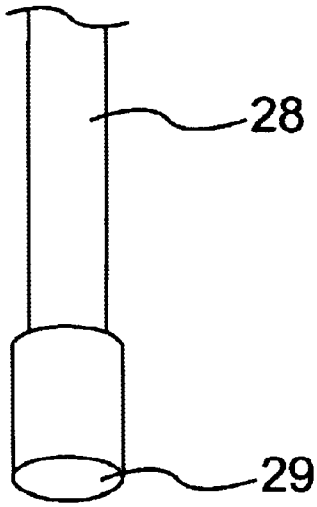
FIG. 8 is a perspective view of a stem extension rod.

FIG. 5 illustrates the cap 12 which pressure fits directly onto the outer stem 16 (FIG. 1) or the stem rod extension 28 (FIG. 8). It's the cap 12 (FIG. 5) that enables other outer housings concealing the banner 13 (FIG. 2) with the custom message to be easily attached to the outer stem 16 (FIG. 1) or the stem rod extension 28 (FIG. 8). All outer housings may be manufactured with a universally sized cap 12 so they can easily attach to the pop-up mechanism.

FIG. 8 is a perspective view of the stem rod extension 28. The stem rod extension 28 is used for extending the height of the outer stem 16 (FIG. 1) of pop-up surprise. Since floral arrangements range from 10" to 24" in height, pop-up surprise must be easily adjustable. The stem rod extension 28 is made of a very light plastic or material that can be easily cut to size with standard floral scissors. The outer stem connector 29 is a pressure fitting apparatus, enabling easy attachment of the stem rod extension 28 to the outer stem 16 (FIG. 1). Both the stem rod extension 28 and of the outer stem connector 29 are the primary features which allow adjustment of the height of the outer stem 16 (FIG. 1) of pop-up surprise.

Figure 6:
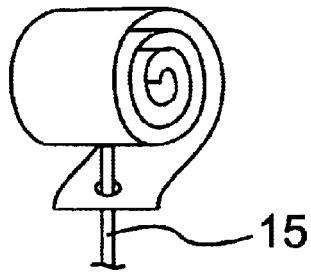
FIG. 6 is a perspective view of a stand alone look at the rolled up banner and banner attachments.
Figure 7:
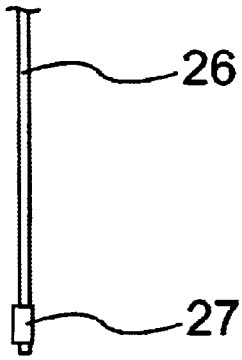
FIG. 7 is a perspective view of a pop-up extension rod.

The banner 13 (FIG. 2) is made of ribbon, paper, or cloth that can be written on. It also comes in all shapes and sizes: a heart shape, a flag shape, a post-it shape, just to name a few. FIG. 6 illustrates the banner 13 in its rolled up position depicting how it is positioned when placed in the banner compartment 11 (FIG. 5). An attachment is connected to the banner 13 via glue or snap and is the component that makes it easy to connect the banner 13 with the preprinted message directly to the pop-up rod 24 (FIG. 4) or pop-up rod extension 26 (FIG. 7). The attachment (FIG. 6) is a hollow tube that simply slides over the pop-up rod 24 (FIG. 4) or pop-up rod extension 26 (FIG. 7) making a pressure fit.

Figure 2:
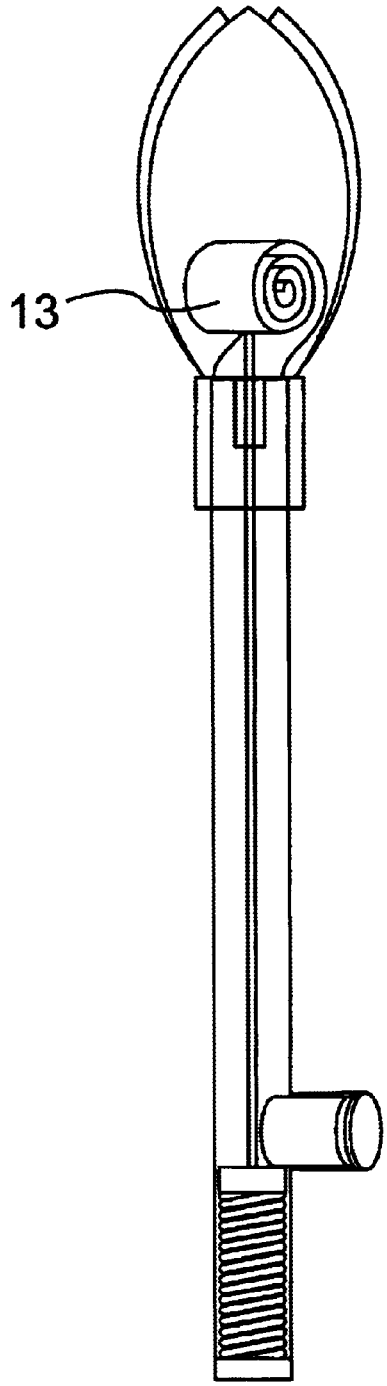
FIG. 2 is a perspective view of an internal representation of pop-up surprise, illustrating the invention in the cocked positions.
Figure 3:
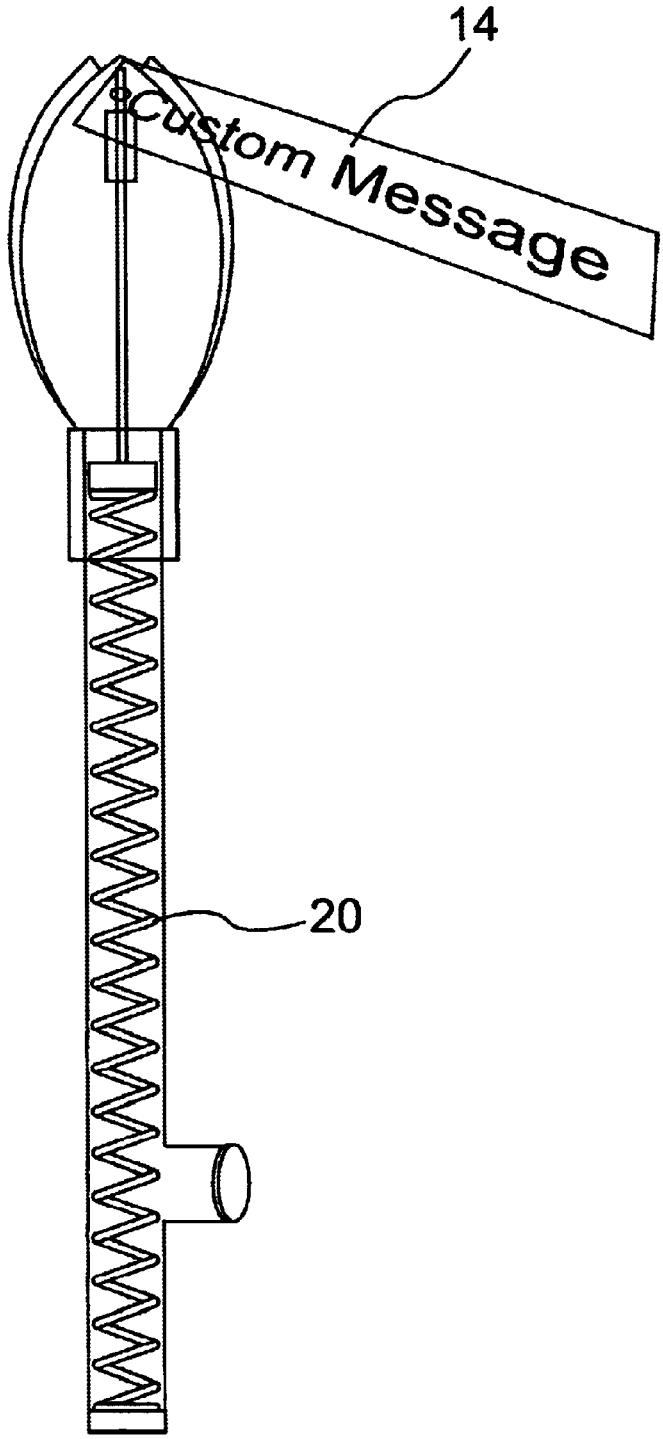
FIG. 3 is a perspective view of an activated representation of pop-up surprise, illustrating the banner in the revealed positions.

FIG. 3 is a perspective view of an activated representation of pop-up surprise which illustrates the banner 13 in the revealed position. The unrolled banner 13 in this illustration has been pushed up from inside the banner compartment 11 (FIG. 5) revealing the pre-printed message. When the tablet 22 (FIG. 4) dissolves due to its submersion in water, it releases the spring 19 (FIG. 4), notice the position of the sprung spring 19 in FIG. 3. The tablet 22 (FIG. 4) has released the spring 19 (FIG. 4) allowing the pop-up rod 24 (FIG. 4) to push up. Once the banner 13 (FIG. 2) is pushed up through the banner compartment 11 (FIG. 5) the banner 13 (FIG. 2) unrolls and reveals the pre-printed message. The Sprung spring 19 (FIG. 3) prevents the banner 13 from falling back into the banner compartment 11, (FIG. 5) leaving it exposed to surprise the recipient.

Figure 4:
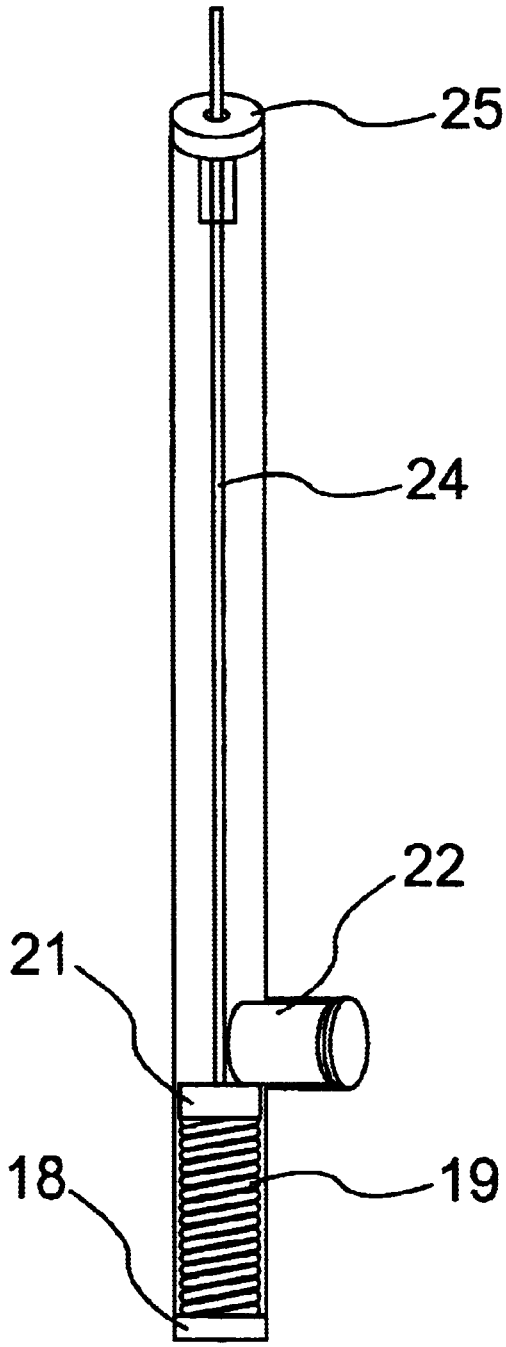
FIG. 4 is a perspective view of a stand-alone look at the pop-up mechanisms.

FIG. 4 is a perspective view of a stand alone look at the pop-up mechanism. The pop-up mechanism is the main component of the invention. It contains all of the moving parts such as the spring 19, the pop-up rod 24, and the tablet 22. It is also the base to which every component of pop-up surprise attaches. The pop-up mechanisms stand alone design is what makes it easy to attach different outer housings to it, giving the flexibility to customize pop-up surprise specifically to a theme or occasion. The FIG. 4 perspective illustrates the pop-up mechanism in the cocked position, the spring 19 is held down by the spring compressor 21 (FIG. 4), which is held into place by the tablet 22 contained in the tablet compartment 17 (FIG. 1). The tablet compartment 17 (FIG. 1) is plugged with a timed release glue stop (FIG. 1) which not only helps in the delay of revealing the custom message but also protects the tablet 22. The bottom plug 18 is pressure fitted and its sole purpose is to hold the spring 19 in position. Its pressure fit design is for easy assembly of the internal components of the invention. Once the tablet 22 dissolves, thus activating the spring 19, the spring compressor stop 25 prevents any part of the device from completely flying out of the unit.

FIG. 7 is a perspective view of a pop-up rod extension 26. The pop-up rod extension 26 is the feature that allows lengthening of the pop-up rod 24 (FIG. 4) so that pop-up surprise can fit in any size floral arrangement. The pop-up rod extension 26 is attached to the extension rod connector 27 which directly pressure fits to the pop-up rod 24 (FIG. 4). Like the stem rod extension 28 (FIG. 8) the pop-up rod extension 26 can be easily cut with standard floral scissors.

FIG. 2 is a perspective view of an internal representation of pop-up surprise, which illustrates the invention in the cocked position. FIG. 2 is the best perspective to understand the concept of the invention. It resembles a flower bud so that it can blend in with any real bouquet of flowers. The outer housing 10 is attached to the cap 12 (other outer housings can be manufactured with the cap 12 attachment) for easy attachment to the outer stem 16. The spring 19 is illustrated in the compressed position and is held down by the spring compressor 21. Once the tablet 22 dissolves due to being submerged in water, it releases into the sprung spring 19 (See FIG. 3) position, pushing the pop-up rod 24, which pushes the banner 13 with the preprinted message up through the banner compartment 11.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A pop-up surprise for revealing an unexpected message via a timed release mechanism comprising:

internal components for actuating means for displaying a message;

means for housing a message;

means for attaching outer housings to an outer stem;

means for displaying a message;

means for housing the internal components, connected to said means for attaching outer housings to the outer stem;

means for bracing a spring and pop-up rod, pressingly connected to said means for housing the internal components;

means for pushing up a pop-up rod, pressingly connected to said means for bracing a spring and pop-up rod;

means for holding the spring in the compressed position, pressingly connected to said means for pushing up a pop-up rod;

means for holding a tablet, rigidly connected to said means for housing the internal components;

means for releasing the compressed spring submersed in to said means for holding a tablet for pushing a banner up, connected to said means for holding the spring in the compressed position; and means for preventing the pop-up rod from flying out of the outer stem, connected to said means for holding the spring in the compressed position, and connected to said means for housing the internal components.

2. The pop-up surprise in accordance with claim 1, wherein said means for housing a message comprises a banner compartment.

3. The pop-up surprise in accordance with claim 1, wherein said means for attaching outer housings to the outer stem comprises a cap.

4. The pop-up surprise in accordance with claim 1, wherein said means for displaying a message comprises an extendible banner.

5. The pop-up surprise in accordance with claim 1, wherein said means for housing the internal components comprises a hollow outer stem.

6. The pop-up surprise in accordance with claim 1, wherein said means for bracing a spring and pop-up rod comprises a bottom plug.

7. The pop-up surprise in accordance with claim 1, wherein said means for pushing up a pop-up rod comprises a compressible spring.

8. The pop-up surprise in accordance with claim 1, wherein said means for holding the spring in the compressed position comprises a spring compressor.

9. The pop-up surprise in accordance with claim 1, wherein said means for holding a tablet comprises a tablet compartment.

10. The pop-up surprise in accordance with claim 1, wherein said means for releasing the spring compressor comprises a dissolvable, time release tablet.

11. The pop-up surprise in accordance with claim 1, wherein said means for pushing the banner up comprises a pop-up rod.

12. The pop-up surprise in accordance with claim 1, wherein said means for preventing the pop-up rod from flying out of the outer stem comprises a spring compressor stop.

13. A pop-up surprise for revealing an unexpected message via a timed release mechanism comprising:

a banner compartment for housing a message;

a cap for attaching outer housings to the outer stems;

an extendible banner for displaying a messages;

a hollow outer stem for housing the internal components, connected to said cap;

a bottom plug for bracing a spring and pop-up rod, pressingly connected to said outer stem;

a compressible spring, for pushing up a pop-up rod, pressingly connected to said bottom plug;

a spring compressor for holding the spring in the compressed position, pressingly connected to said spring;

a tablet compartment for holding a tablet, rigidly connected to said outer stem;

a dissolvable, time release tablet for releasing the compressed spring submersed in said tablet compartment;

a pop-up rod for pushing a banner up, connected to said spring compressor; and a spring compressor stop for preventing the pop-up rod from flying out of the outer stem, connected to said spring compressor, and connected to said outer stem.

14. The pop-up surprise as recited in claim 13, further comprising:

an outer housing, having a bud like appearance or any appearance deemed appropriate, for camouflaging a message in a floral arrangement, connected to said banner compartment, and pressingly connected to said cap.

15. The pop-up surprise as recited in claim 14, further comprising:

an adjustable pop-up rod extensions for adjusting the height of the hollow outer stem, connected to said extension rod connector.

16. The pop-up surprise as recited in claim 15, further comprising:

an extension rod connector for coupling, connected to said pop-up rod extension, and pressingly connected to said pop-up rod.

17. The pop-up surprise as recited in claim 16, further comprising:

an adjustable stem rod extension for adjusting the length of the outer stem, pressingly connected to said outer stem connector, and pressingly connected to said outer housing.

18. The pop-up surprise as recited in claim 17, further comprising:

an outer stem connector for coupling, pressingly connected to said stem rod extension, and pressingly connected to said outer stem.

19. The pop-up surprise as recited in claim 16, further comprising:

an outer stem connector for coupling, pressingly connected to said stem rod extension, and pressingly connected to said outer stem.

20. The pop-up surprise as recited in claim 15, further comprising:

an adjustable stem rod extension for adjusting the length of the outer stem, pressingly connected to said outer stem connector, and pressingly connected to said outer housing.

21. The pop-up surprise as recited in claim 20, further comprising:

an outer stem connector for coupling, pressingly connected to said stem rod extension, and pressingly connected to said outer stem.

22. The pop-up surprise as recited in claim 15, further comprising:

an outer stem connectors for coupling, pressingly connected to said stem rod extension, and pressingly connected to said outer stem.

23. The pop-up surprise as recited in claim 14, further comprising:

an extension rod connectors for coupling, connected to said pop-up rod extension, and pressingly connected to said pop-up rod.

24. The pop-up surprise as recited in claim 23, further comprising:

an adjustable stem rod extension for adjusting the length of the outer stem, pressingly connected to said outer stem connector, and pressingly connected to said outer housing.

25. The pop-up surprise as recited in claim 24, further comprising:

an outer stem connector for coupling, pressingly connected to said stem rod extension, and pressingly connected to said outer stem.

26. The pop-up surprise as recited in claim 23, further comprising:

an outer stem connector for coupling, pressingly connected to said stem rod extension, and pressingly connected to said outer stem.

27. The pop-up surprise as recited in claim 14, further comprising:

an adjustable stem rod extensions for adjusting the length of the outer stem, pressingly connected to said outer stem connector, and pressingly connected to said outer housing.

28. The pop-up surprise as recited in claim 27, further comprising:

an outer stem connector for coupling, pressingly connected to said stem rod extension, and pressingly connected to said outer stem.

29. The pop-up surprise as recited in claim 14, further comprising:

an outer stem connector for coupling, pressingly connected to said stem rod extension, and pressingly connected to said outer stem.

30. The pop-up surprise as recited in claim 13, further comprising:

an adjustable pop-up rod extension for adjusting the height of the hollow outer stem.

31. The pop-up surprise as recited in claim 30, further comprising:

an extension rod connector for coupling, connected to said pop-up rod extension, and pressingly connected to said pop-up rod.

32. The pop-up surprise as recited in claim 31, further comprising:

an adjustable stem rod extension for adjusting the length of the outer stem, pressingly connected to said outer stem connector, and pressingly connected to said outer housing.

33. The pop-up surprise as recited in claim 32, further comprising:

an outer stem connector for coupling, pressingly connected to said stem rod extension, and pressingly connected to said outer stem.

34. The pop-up surprise as recited in claim 31, further comprising:

an outer stem connector for coupling, pressingly connected to said stem rod extension, and pressingly connected to said outer stem.

35. The pop-up surprise as recited in claim 30, further comprising:

an adjustable stem rod extension for adjusting the length of the outer stem, pressingly connected to said outer stem connector, and pressingly connected to said outer housing.

36. The pop-up surprise as recited in claim 35, further comprising:

an outer stem connector for coupling, pressingly connected to said stem rod extension, and pressingly, connected to said outer stem.

37. The pop-up surprise as recited in claim 30, further comprising:

an outer stem connector for coupling, pressingly connected to said stem rod extension, and pressingly connected to said outer stem.

38. The pop-up surprise as recited in claim 13, further comprising:

an extension rod connector for coupling, connected to said pop-up rod extension, and pressingly connected to said pop-up rod.

39. The pop-up surprise as recited in claim 38, further comprising:

an adjustable stem rod extension for adjusting the length of the outer stem, pressingly connected to said outer stem connector, and pressingly connected to said outer housing.

40. The pop-up surprise as recited in claim 39, further comprising:

an outer stem connector for coupling, pressingly connected to said stem rod extension, and pressingly connected to said outer stem.

41. The pop-up surprise as recited in claim 38, further comprising:

an outer stem connector for coupling, pressingly connected to said stem rod extension, and pressingly connected to said outer stem.

42. The pop-up surprise as recited in claim 13, further comprising:

an adjustable stem rod extension for adjusting the length of the outer stem, pressingly connected to said outer housing.

43. The pop-up surprise as recited in claim 42, further comprising:

an outer stem connector for coupling, pressingly connected to said stem rod extension, and pressingly connected to said outer stem.

44. The pop-up surprise as recited in claim 13, further comprising:

an outer stem connector for coupling, pressingly connected to said stem rod extension, and pressingly connected to said outer stem.

45. A pop-up surprise for revealing an unexpected message via a timed release mechanism comprising:

a flower resembling material outer housing, having an appearance for camouflaging a message in a floral arrangement;

a banner compartment for housing a message, connected to said outer housing;

a pressure fit cap for attaching outer housings to an outer stem, pressingly connected to said outer housing;

a banner for displaying a message;

a hollow outer stem for housing internal components, connected to said cap;

a pressure fit bottom plug for bracing a spring and pop-up rod, pressingly connected to said outer stem;

a compressible spring, for pushing up a pop-up rod, pressingly connected to said bottom plug;

a spring compressor for holding the spring in the compressed position, pressingly connected to said spring;

a tablet compartment for holding a tablet, rigidly connected to said outer stem a dissolvable, said tablet comprising sodium citrate and sodium acetylsalicylate, for releasing the spring compressor, submersed in said tablet compartment;

a pop-up rod for pushing the banner up, connected to said spring compressor;

a pressure fit spring compressor stop for preventing the pop-up rod from flying out of the outer stem, connected to said spring compressor, and connected to said outer stem;

an adjustable pop-up rod extension for adjusting the height of the outer housing;

an extension rod connector for coupling, connected to said pop-up rod extension, and pressingly connected to said pop-up rod;

an adjustable stem rod extension for adjusting the length of the outer stem, pressingly connected to said outer housing; and an outer stem connector for coupling, pressingly connected to said stem rod extension, and pressingly connected to said outer stem.

* * * * *